United States Patent [19]

Wesselmann et al.

[11] Patent Number: 4,461,211

[45] Date of Patent: Jul. 24, 1984

[54] FLUSH INKING MECHANISM FOR A ROTARY PRINTING PRESS

[75] Inventors: Heinz Wesselmann, Tecklenburg; Walter Wessel, Lengerich, both of Fed. Rep. of Germany

[73] Assignee: Windmoller & Holscher, Lengerich, Fed. Rep. of Germany

[21] Appl. No.: 402,345

[22] Filed: Jul. 27, 1982

[30] Foreign Application Priority Data

Jul. 29, 1981 [DE] Fed. Rep. of Germany ..... 3129951
Sep. 9, 1981 [DE] Fed. Rep. of Germany ..... 3135711

[51] Int. Cl.[3] ..... B41F 31/04; B41F 31/08; B41L 27/06

[52] U.S. Cl. ..... 101/366; 101/169

[58] Field of Search ..... 101/DIG. 14, 348, 349, 101/350, 351, 352, 148, 207, 208–210, 157, 169, 366, 365, 363, 364; 118/261

[56] References Cited

U.S. PATENT DOCUMENTS

| | | | |
|---|---|---|---|
| 2,018,193 | 10/1935 | Smith | 101/366 |
| 2,081,906 | 6/1957 | Ball | 101/366 |
| 2,151,969 | 3/1939 | Henderson | 101/366 X |
| 2,177,656 | 10/1939 | Kaddeland | 101/366 X |
| 2,534,670 | 12/1950 | Harrold | 101/364 |
| 3,298,305 | 1/1967 | Noon | 101/366 |

FOREIGN PATENT DOCUMENTS

| | | | |
|---|---|---|---|
| 2317213 | 10/1974 | Fed. Rep. of Germany | 101/169 |

*Primary Examiner*—I. Reed Fisher
*Attorney, Agent, or Firm*—Fleit, Jacobson, Cohn & Price

[57] ABSTRACT

In an inking mechanism for a rotary printing press, an inked distributing channel is defined between an ink applicator roller, a doctor blade holder and two doctor blades, the blade holder being articulated to a shaft so that the blades rest on the surface of the applicator roller.

8 Claims, 3 Drawing Figures

FLUSH INKING MECHANISM FOR A ROTARY PRINTING PRESS

The invention relates to a flush inking mechanism for a rotary printing press, comprising a doctor blade which can be applied to the ink applicator roller, is secured to a doctor blade holder pivotable about an axis above and parallel to the applicator roller axis, and can be applied to the applicator roller by a piston-cylinder unit acting on the doctor blade holder, and ink distributing channel formed between the doctor blade, doctor blade holder and applicator roller, an ink supply conduit, and a trough for collecting ink flowing out of the distributing channel.

In a flush inking mechanism of this kind known from DE-AS No. 18 06 140, the doctor blade holder is secured to a supporting carrier which is pivotable about pins on a collecting tube fixed with respect to the frame. Secured to the collecting tube there are hydraulic applicator means of which the actuating means are supported on the carrier and, by way thereof, press the doctor blade against the ink applicator roller.

In the known apparatus, the hydraulic applicator means have to exert the entire force for applying the doctor blade. It is therefore the problem of the invention to improve the known flush inking mechanism so that, for the fine application of the doctor blade, the piston-cylinder unit has to exert only small applying forces or none at all.

According to the invention, this problem is solved in that the ink distributing channel is closed by a second doctor blade which is secured to the doctor blade holder and can be applied to the ink applicator roller, and that the bar forming the doctor blade holder is pendulatingly secured to a shaft such that the doctor blades are laterally supported on the surface of the applicator roller.

The construction of the flush inking mechanism according to the invention and its manipulation are considerably simplified compared with known apparatuses.

Desirably, one doctor blade is made of more elastic material than the other so that the doctor blades will be sure to lie well against the screen roller if the doctor blades are not accurately aligned with respect thereto. By reason of its greater elasticity and flexibility, the more elastic doctor blade compensates any wrong position of the ink applicator bar.

Advantageous embodiments of the invention have been described in the subsidiary claims.

One example of the invention will now be described in more detail with reference to the drawing, wherein.

Figure 1:
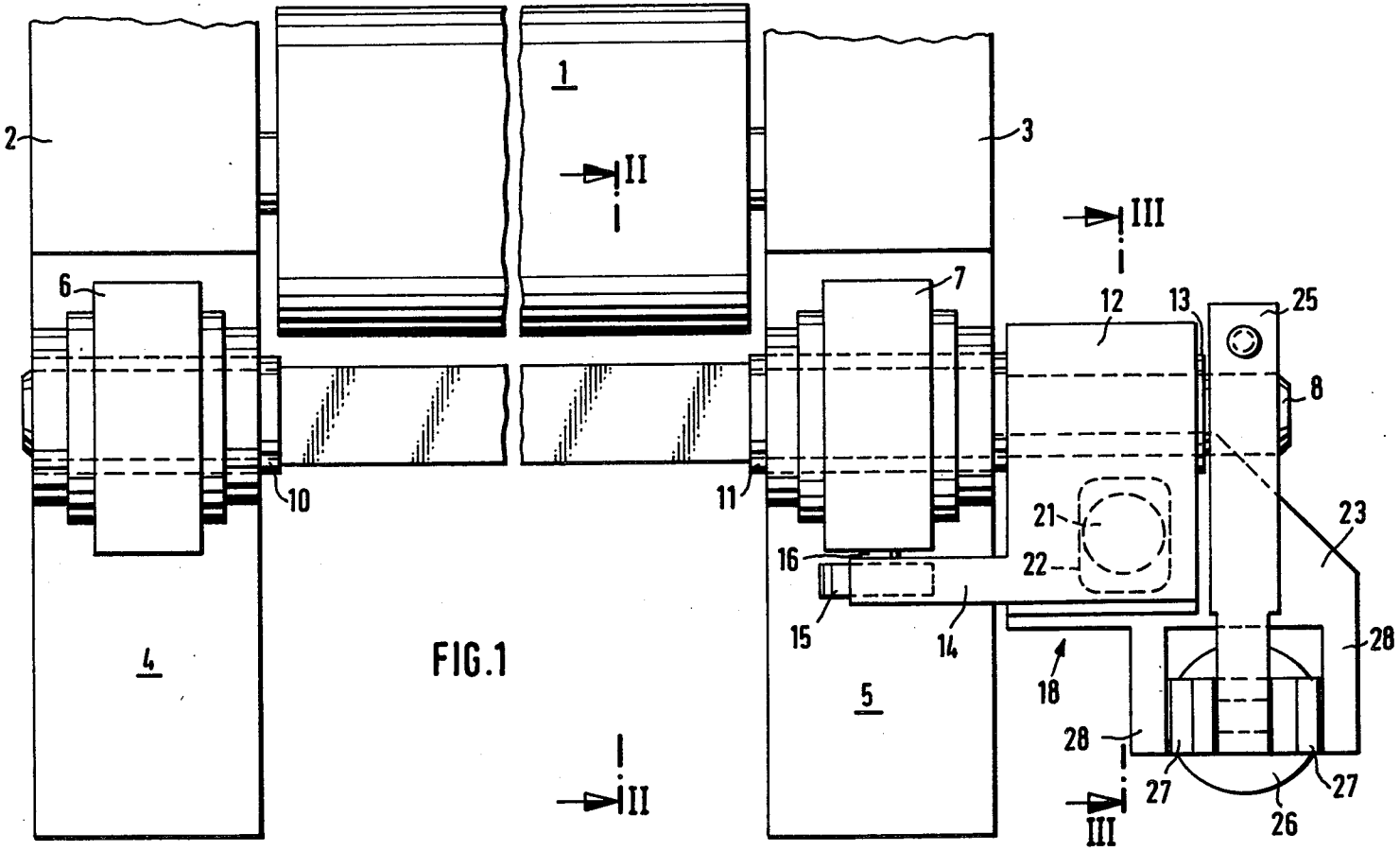
FIG. 1 is a plan view of the ink applictor roller as well as the shaft carrying the flush inking mechanism, the latter itself being omitted.
Figure 2:
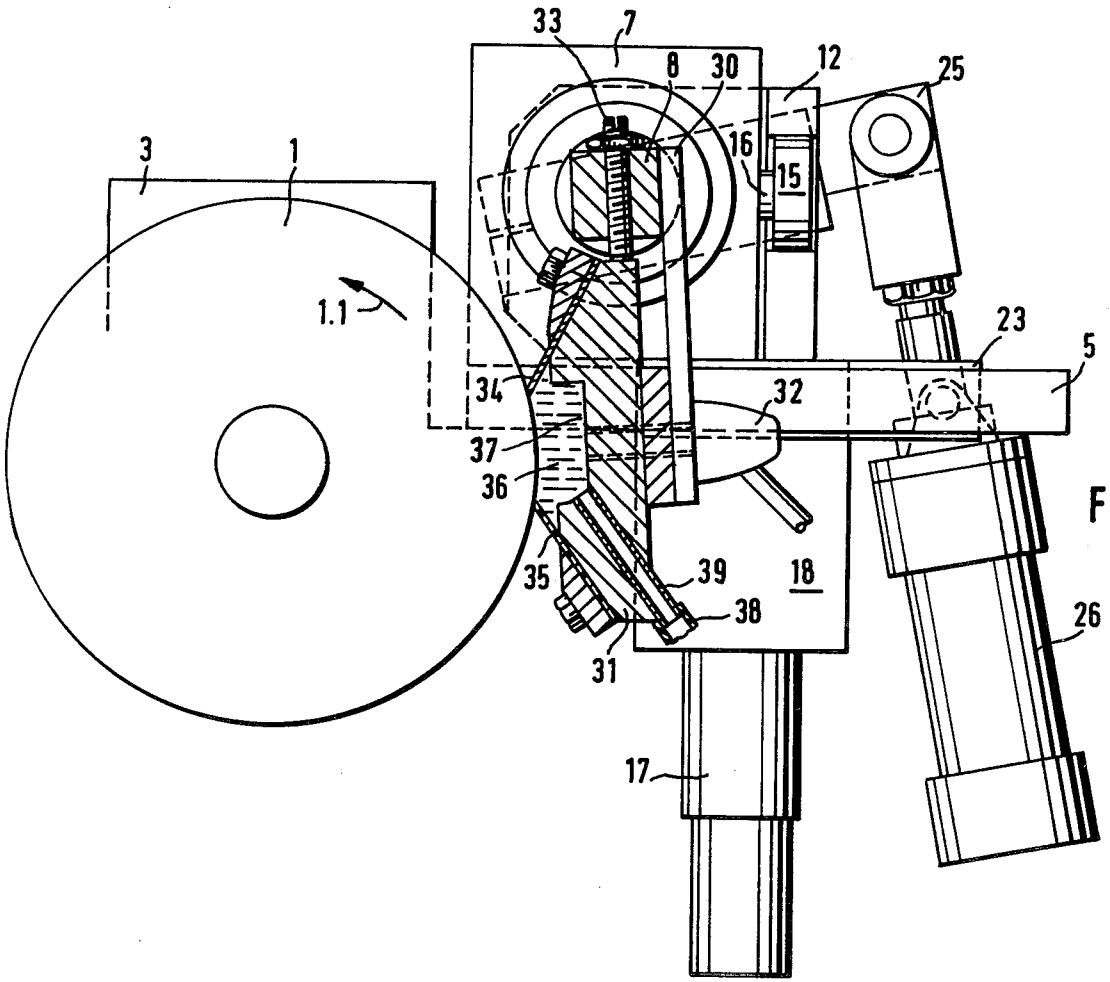
FIG. 2 is a section on the line II—II of the FIG. 1 apparatus, with the flush inking mechanism secured to the shaft
Figure 3:
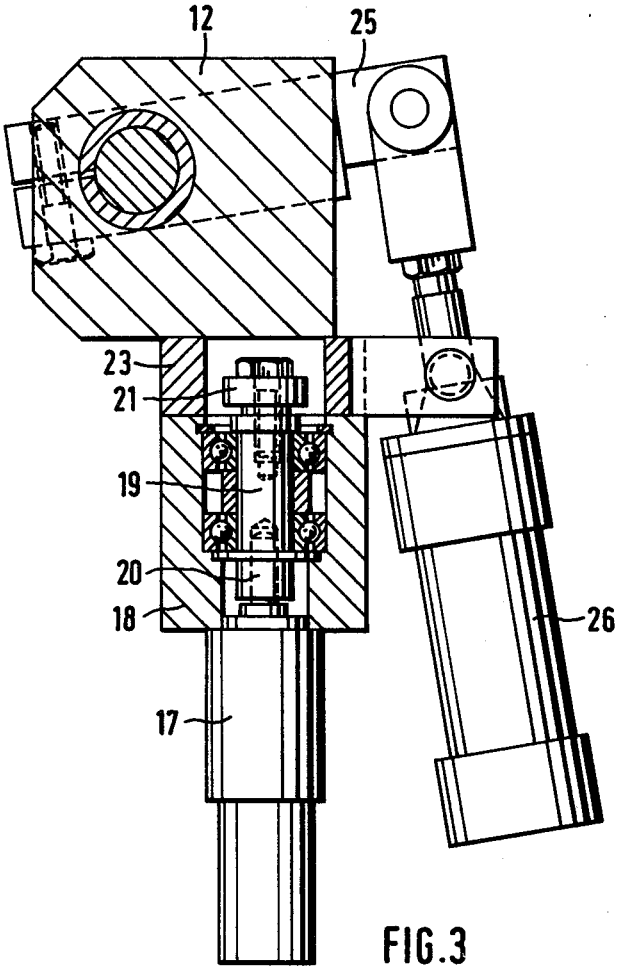
FIG. 3 is a section of the apparatus along the line III—III in FIG. 1.

The screen roller 1 forming the ink applicator roller is mounted in inking mechanism blocks 2, 3. Screwed onto the blocks 2 and 3 there are supporting plates 4, 5 on which the plummer blocks 6, 7 are secured. A shaft 8 mounted in the plummer blocks 6, 7 for rotation and longitudinal displacement is square at a section disposed between the plummer blocks 6, 7. The cages 6, 7 of the ball bearing means for the shaft 8 extend beyond the width of the plummer blocks 6, 7. The shaft 8 is extended to the right.

A guide member 12 is rotatably mounted on the projecting part of the shaft 8 but is secured against longitudinal displacement on the shaft 8 by a securing ring 13 which engages in the shaft 8. The guide member 12 comprises a fork 14 in which there is fitted a ball bearing 15 of which the inner ring is secured in the plummer block 7 by a bolt 16. By means of this arrangement, the guide member 12 is prevented from rotating with respect to the shaft 8 but its doctor movement, i.e. movement lengthwise of the shaft 8, is permitted. This doctor movement is initiated by an electric motor 17 screwed to a bearing housing 18 secured to the inking mechanism block 3. The drive pin 20 of the electric motor 17 engages in a shaft 19 rotatably mounted in the bearing housing 18. An inner ring of a ball bearing 21 is eccentrically secured on the shaft 19, the outer ring being fitted in a groove 22 formed in a plate 23. The plate 23 is secured to the guide member 12 so that the eccentric motion of ball bearing 21 is transmitted as reciprocating motion to the shaft 8.

Finally, a lever 25 clamped to the projecting part of the shaft 8 has its free end pivoted to the piston rod of a pneumatic cylinder 26. Ears 27 on the pneumatic cylinder 26 are pivoted to a fork 28 formed on the plate 23 so that the pneumatic cylinder 26 can move freely when actuated. By means of the pneumatic cylinder 26, the shaft 8 can be swung about its longitudinal axis and thereby applied to or lifted off the screen roller 1.

A bar 30 reinforced at its end is secured to the part of the shaft 8 that has a square cross-section and is disposed between the plummer blocks 6, 7. An ink applicator bar 31 is screwed to the bar 30 with the aid of two T screws 32 which are uniformly distributed along the length of the ink applicator bar 31. The T screws engage through somewhat larger apertures in the bar 30 so that the ink applicator bar 31 can be displaced within limits.

Adjustable abutment screws 33 provided at a suitable spacing from one another in the square portion of the shaft 8 serve as abutments for the applicator bar 31 so that the latter will assume its desired position relatively to the screen roller 1. For rotation of the screen roller 1 in the direction of the arrow 1.1, a doctor blade 34 and a scraper blade 35 are screw-connected to the ink applicator bar 31. There is therefore formed between the screen roller 1, the ink applicator bar 31 and the blades 34, 35 a cavity 36 which is enlarged by a recess extending over the entire length of the ink applicator bar 31. A hose 38 supplies ink to the cavity 36 through a tube 39 in a manner not shown. In order that the ink will not immediately flow off beyond the ends, these are covered in known manner (not shown) by cover plates which partially also overlap the end faces of the screen rollers 1. These cover plates do not exactly seal off with the screen roller 1 so that at this position ink and any impurities in the ink can flow off and be collected by a drip plate (not shown).

The centre of gravity of the ink applicator bar 31 is disposed beneath the shaft 8 so that it will lie against the screen roller 1 under its own weight. If the ink is to be changed, the ink applicator bar 31 can be lifted off the screen roller 1 by actuating the pneumatic cylinder 26 and, after loosening the screws 32, removed from the press. By actuating the pneumatic cylinder 26 in the opposite sense, the ink applicator bar 31 can be pressed against the screen roller 1 if this should be necessary.

I claim:

1. A flush inking mechanism for a rotary press, comprising:

an ink applicator roller;

a doctor blade holder pivotable about an axis above and parallel to the applicator roller axis by a piston-cylinder unit acting on the doctor blade holder;

an ink distributing channel formed in and extending along one side of said doctor blade holder;

an ink supply conduit in communication with said ink distributing channel;

means for collecting ink flowing out of the ends of said ink distributing channel,; and said doctor blade holder including a first doctor blade and a second doctor blade, each of which extends outwardly from said blade holder and can be applied against the surface of the ink applicator roller, said doctor blade holder being pendulatingly secured to a shaft the axis of which defines said pivot axis, said doctor blades being laterally supported on the surface of the applicator roller and defining sides of an ink cavity with said applicator roller and said doctor blade holder, one of said doctor blades having a greater flexibility than the other to permit compensation for misalignment of said doctor blade holder relative to said ink applicator roller.

2. A flush inking mechanism according to claim 1, wherein said shaft is connected to a downwardly directed supporting member secured to said doctor blade holder.

3. A flush inking mechansim according to claim 1 or claim 2, wherein said shaft includes spaced adjustment screws that abut the upper edge of the doctor blade holder.

4. A flush inking mechanism according to claim 2 wherein said shaft is square in a zone serving to secure the supporting member.

5. A flush inking mechansim according to claims 1 or 2 wherein said shaft includes a lever secured to one end thereof and pivoted to the piston rod of the piston-cylinder unit for applying and retracting the doctor blades relative to said applicator roller.

6. A flush inking mechanism according to claims 1 or 2, wherein said shaft is axially displaceable, a guide member secured to said shaft, said shaft connected for rotation with but against axial displacement with respect to said guide member, said guide member including an extension substantially parallel to and spaced from the axis of said shaft and being axially displaceable in a frame, said guide member including an elongate hole in which a driven eccentrically mounted round cam engages for reciprocating the shaft.

7. A flush inking mechanism according to claim 6, wherein the cylinder of the piston-cylinder unit is pivotably mounted in the guide member.

8. A flush inking mechansim according to claim 7, wherein one doctor blade is of steel and the other doctor blade serves as a scraper blade and is of plastics material.

* * * * *